US008995701B2

(12) United States Patent
Akino

(10) Patent No.: US 8,995,701 B2
(45) Date of Patent: Mar. 31, 2015

(54) MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 731 days.

(21) Appl. No.: 13/191,944

(22) Filed: Jul. 27, 2011

(65) Prior Publication Data

US 2012/0027239 A1 Feb. 2, 2012

(30) Foreign Application Priority Data

Jul. 30, 2010 (JP) ..... 2010-172219

(51) Int. Cl.
*H04R 9/08* (2006.01)
*H04R 3/04* (2006.01)
*H04R 1/28* (2006.01)

(52) U.S. Cl.
CPC ... *H04R 3/04* (2013.01); *H04R 1/28* (2013.01)
USPC ..... 381/369; 381/355

(58) Field of Classification Search
CPC ..... H04R 3/002; H04R 1/04; H04R 9/08; H04R 17/02; H04R 2400/01; H04R 2410/00; G10K 11/1788
USPC ..... 381/96
See application file for complete search history.

(56) References Cited

U.S. PATENT DOCUMENTS 6,118,878 A * 9/2000 Jones ..... 381/72
2007/0223736 A1* 9/2007 Stenmark et al. ..... 381/103
2008/0267431 A1* 10/2008 Leidl et al. ..... 381/173

FOREIGN PATENT DOCUMENTS

JP 04-281696 A 10/1992
JP 07-015782 1/1995
JP 2001-275184 A 10/2001
JP 2009-232176 10/2009
JP 2010-010984 A 1/2010

* cited by examiner

*Primary Examiner* — Joseph Saunders, Jr.
(74) *Attorney, Agent, or Firm* — Whitham Curtis Christofferson & Cook, PC

(57) ABSTRACT

An electroacoustic transducer includes a diaphragm, an electroacoustic transducer unit having the diaphragm, and an air chamber having the diaphragm of the electroacoustic transducer unit and having a variable volume in response to vibration of the diaphragm. The air chamber has a sound pressure detector detecting a sound pressure in the air chamber and a volume adjuster driven by the output signals from the sound pressure detector, changing the volume of the air chamber in response to the output signals, and controlling the acoustic impedance of the air chamber. A control system from the sound pressure detector to the volume adjuster configures a feedback control system increasing the volume of the air chamber with an increase in the sound pressure in the air chamber.

4 Claims, 8 Drawing Sheets

MICROPHONE

BACKGROUND OF THE INVENTION

1. Field of the Invention

The present invention relates to an electroacoustic transducer having an air chamber in back of a diaphragm, the electroacoustic transducer actively canceling a sound pressure generated in the air chamber such that the air chamber functions as a large-volume air chamber even if the air chamber has a small volume, and thus enhancing bass response.

2. Related Background Art

Electroacoustic transducers, for example, unidirectional dynamic microphones, omnidirectional dynamic microphones, headphones, and speakers may each have an air chamber to prevent sound waves from entering from the outside. Such an electroacoustic transducer has a diaphragm that vibrates in response to sound waves or generates sound waves as being driven by audio signals. The air chamber is provided in back of the diaphragm. The air chamber functions as an acoustic capacitance. Specifically, a large air chamber functions as a lowly resilient spring, while a small air chamber as a highly resilient spring. Thus, in the case where an acoustic capacitance having a small stiffness is required, namely, the diaphragm can be moved easily, a large-volume air chamber is needed.

The air chamber is explained in more detail in the case of an omnidirectional or unidirectional dynamic microphone as an example herein. In the omnidirectional or unidirectional dynamic microphone, an acoustic resistance and an air chamber should be provided in a rear portion or in back of a diaphragm in order to obtain omnidirectional components. The stiffness of the air chamber is dominant in a low frequency range. If the air chamber has a small volume, the stiffness is high and directional frequency response is low. Thus, the volume of the air chamber must be increased to reduce the stiffness.

In a hand-held wireless microphone, a transmitter circuit and a power battery should be housed in a grip, and thus a large air chamber cannot be provided like a wired microphone. Accordingly, the air chamber in the rear portion of the diaphragm is limited in volume and omnidirectional components should be obtained in a small air chamber. This results in poor directional frequency response and sound quality in bass sound. Specifically, if a small air chamber responds to bass sound to vibrate a diaphragm, a large back pressure is applied to the diaphragm. The diaphragm is then difficult to vibrate, thus increasing the lowest responding frequency level and reducing the bass output level.

The inventor of the present invention invented and filed a patent application of a dynamic microphone reducing an acoustic impedance in a back air chamber in an equivalent manner to allow pickup of bass sound even in a small-volume back air chamber (refer to Japanese Unexamined Patent Application Publication No. 2009-232176). In the invention disclosed in Japanese Unexamined Patent Application Publication No. 2009-232176, the back air chamber is provided in back of a diaphragm of a main microphone unit and a sub-microphone unit is disposed in front of the main microphone unit in a casing that supports the main microphone unit. Audio signals (voltage signals) output from the sub-microphone unit drive a membrane composed of a piezoelectric element in the back air chamber, thus reducing the acoustic impedance in the back air chamber in an equivalent manner.

According to the invention disclosed in Japanese Unexamined Patent Application Publication No. 2009-232176, sound waves from a sound source directed to the sub-microphone unit disposed in front of the main microphone unit are converted into audio signals in the sub-microphone unit. The audio signals drive the membrane composed of the piezoelectric element in the back air chamber. The output signals from the sub-microphone unit disposed in front of the diaphragm of the main microphone unit feedforward-controls the membrane composed of the piezoelectric element. In response to the sound waves from the sound source reaching the sub-microphone unit, a pressure change in the back air chamber is estimated and the membrane is driven based on the estimation. Thus, the membrane cannot be driven properly in accordance with the pressure change in the back air chamber. A further improvement is required for acoustic impedance control in the back air chamber at high accuracy.

SUMMARY OF THE INVENTION

In view of the circumstances above, an object of the prevent invention is to provide an electroacoustic transducer changing a volume of an air chamber properly in accordance with a change in the sound pressure of the air chamber that changes in response to vibration of a diaphragm in an electroacoustic transducer unit, thereby accurately controlling the acoustic impedance of the air chamber.

A main feature of the present invention provides an electroacoustic transducer having a diaphragm, an electroacoustic transducer unit including the diaphragm; and an air chamber accommodating the diaphragm of the electroacoustic transducer unit and having a variable volume in response to vibration of the diaphragm. The air chamber includes a sound pressure detector detecting a sound pressure in the air chamber; and a volume adjuster driven by output signals from the sound pressure detector, changing the volume of the air chamber in response to the output signals, and controlling an acoustic impedance of the air chamber. A control system from the sound pressure detector to the volume adjuster configures a feedback control system increasing the volume of the air chamber with an increase in the sound pressure in the air chamber.

As the diaphragm in the electroacoustic transducer unit vibrates, the volume of the air chamber changes and the sound pressure in the air chamber changes. The feedback control is then performed in which the sound pressure detector detects the sound pressure change and the detection signals drive the volume adjuster to eliminate the sound pressure change. This control reduces the acoustic impedance of the air chamber in an equivalent manner, thus enhancing directional frequency response particularly in bass sound. Even if an air chamber or an enclosure has a small volume in a speaker or headphones as the electroacoustic transducer, sound can be played at a sufficient sound pressure level to bass sound. Even if an air chamber is limited in size due to a power battery loaded in a microphone casing of a microphone, such as a wireless microphone, as the electroacoustic transducer, audio signals can be converted at a predetermined signal level to bass sound.

DESCRIPTION OF THE PREFERRED EMBODIMENTS

Embodiments of an electroacoustic transducer according to the present invention are explained below with reference to the attached drawings.

First Embodiment

Figure 1:
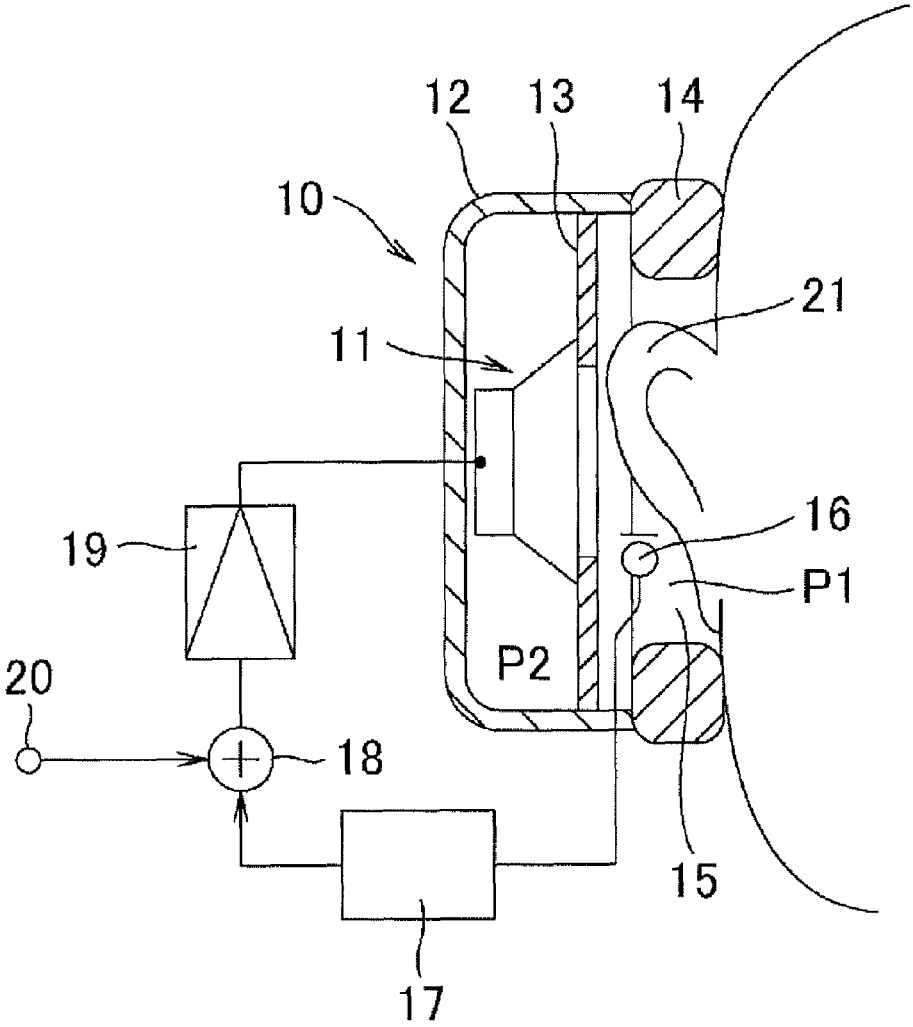
FIG. 1 is a schematic cross-sectional view of an electroacoustic transducer according to an embodiment of the present invention.

An embodiment shown in FIG. 1 is explained, in which the technological concept of the present invention is applied to headphones. In FIG. 1, each headphone 10 has a cup-shaped housing 12; a baffle plate 13 fixed to the internal periphery of the housing 12 proximate to an open end; a speaker unit 11 serving as a driver unit attached to the baffle plate 13 and surrounded by the housing 12; and an ear pad 14 mounted on the open end of the housing 12. The ear pad 14 of the headphone 10 covers an ear 21 of a user and is pressed against the side of the user's head, as commonly known. FIG. 1 illustrates a state where the headphone 10 is worn on one of the ears of the user. Headphones generally include right and left headphones to be worn on right and left ears. The right and left headphones are connected by a headband or a neckband. FIG. 1 illustrates an example ear-covering type headphone having the ear pad 14 covering an ear 21. An ear-mounted type may be employed, in which the ear pad 14 is mounted on the ear 21.

As shown in FIG. 1, the headphone 10 is worn on the side of the user's head. Then, an air chamber 15 is surrounded by the baffle plate 13, a diaphragm (not shown in the drawing) included in the speaker unit 11, a portion of the housing 12, the ear pad 14, and the side of the user's head. Sound is output from the speaker unit 11 toward the air chamber 15 and sound waves reach the eardrum of the user's inner ear. The pressure in the air chamber 15, namely the sound pressure, changes according to the sound waves. The air chamber 15 is provided with a sound pressure detector 16 that detects the sound pressure. An omnidirectional microphone is suitable, but a unidirectional microphone may be used as the sound pressure detector 16.

The speaker unit 11 generates sound driven by sound signals input from a sound source, such as a CD player or an MP3 player. The speaker unit 11 is also driven by detection signals from the sound pressure detector 16. In the example shown in FIG. 1, the detection signals from the sound pressure detector 16 are input to an adder 18 through a circuit block 17, such as an amplifier; are added to sound signals 20 in the adder 18; and are input to the speaker unit 11 through an amplifier 19. The amplifier 19, which serves as a drive circuit of the speaker unit 11, drives the speaker unit 11 using the is detection signals from the sound pressure detector 16 added in the adder 18 and the sound signals 20. Throughout the specification, the sound signals refer to generally-called audio signals, which are electrically converted music, voice, and sound of nature.

In the embodiment configured as shown in FIG. 1, the speaker unit 11 is driven by the sound signals 20 and then outputs sound according to the sound signals 20. The sound pressure in the air chamber 15 changes according to the output sound. The sound pressure detector 16 detects a change in the sound pressure and outputs detection signals associated with the sound pressure. The detection signals are input to the speaker unit 11 through the circuit block 17, the adder 18, and the amplifier 19. The speaker unit 11 is then driven by the detection signals, and thereby the sound pressure in the air chamber 15 is maintained at a constant level.

Specifically, the speaker unit 11 and the air chamber 15 are provided in the embodiment shown in FIG. 1, the speaker unit 11 being an electroacoustic transducer unit provided with a diaphragm which is vibrated by audio signals and generate sound, the air chamber 15 being provided with the diaphragm of the speaker unit 11 and having a variable volume in response to vibration of the diaphragm. The air chamber 15 includes the sound pressure detector 16 that detects the sound pressure in the air chamber 15 and a volume adjuster that is driven by output signals from the sound pressure detector 16 so as to change the volume of the air chamber 15 according to the output signals and thus control the acoustic impedance of the air chamber 15. In the embodiment, the speaker unit 11 also serves as the volume adjuster. The sound pressure detector 16 detects the sound pressure in the air chamber 15 and feeds back the detection signals to the speaker unit 11, which is then controlled such that the sound pressure in the air chamber 15 does not change.

Specifically, in the case where the sound pressure detector 16 detects an increase in the sound pressure in the air chamber 15, the diaphragm of the speaker unit 11 is controlled so as to retract from the air chamber 15, and thereby the acoustic impedance in the air chamber 15 is reduced in an equivalent manner. Thus, even if the air chamber 15 has a small volume, the diaphragm of the speaker unit 11 can be vibrated in response to bass audio signals without resistance, thus improving the directional frequency response properties in bass sound.

Figure 2:
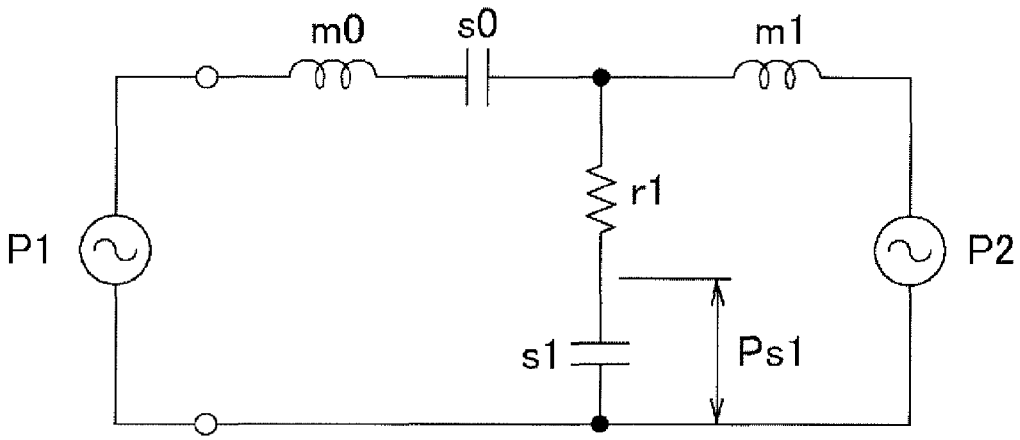
FIG. 2 is an acoustic equivalent circuit diagram of the embodiment.

FIG. 2 illustrates an acoustic equivalent circuit included in the electroacoustic transducer of the embodiment explained above with reference to FIG. 1. In FIG. 2, reference symbol P1 represents a sound pressure of a front sound source, namely the air chamber 15 in the front; reference symbol P2 represents a sound pressure of a back sound source, namely an air chamber in back of the diaphragm of the speaker unit 11; reference symbol m0 represents the mass of the diaphragm; reference symbol s0 represents the stiffness of the diaphragm; reference symbol m1 represents the mass in the back air chamber; reference symbol r1 represents an acoustic resistance in the back air chamber; reference symbol s1 represents the stiffness in the back air chamber; and reference symbol Ps1 represents a sound pressure generated by the stiffness s1. In the case where the back air chamber is small and the stiffness s1 is high, the stiffness s1 is dominant in bass sound and the sound pressure Ps1 is high. The diaphragm thus moves barely. This leads to poor directional frequency response in bass sound. It is desirable to minimize the stiffness s1 in the back air chamber to minimize the sound pressure Ps1 so that only the acoustic resistance r1 functions effectively. To this end, it is preferred that the volume in the back air chamber be increased as much as possible. As explained above, however, many factors limit the volume in the back air chamber.

According to the embodiment of the present invention shown in FIG. 1, the sound pressure in the air chamber 15 changes due to vibration of the diaphragm of the speaker unit 11, which is an electroacoustic transducer unit; the microphone unit 16, which is a sound pressure detector, then detects the change in the sound pressure; and the detection signals drive the speaker unit 11 to reduce the acoustic impedance of the air chamber 15 in an equivalent manner. Thereby, the stiffness s1 is reduced in an equivalent manner and the sound pressure Ps1 is reduced, thus enhancing the directional frequency response in bass sound. In addition, the sound pressure detection signals from detection of the sound pressure in the air chamber 15 are fed back to the speaker unit 11, which also functions as a volume adjuster, so as to prevent a fluctuation in the sound pressure in the air chamber 15. Thus, the equivalent acoustic impedance of the air chamber 15 can be controlled at high accuracy.

Figure 3:
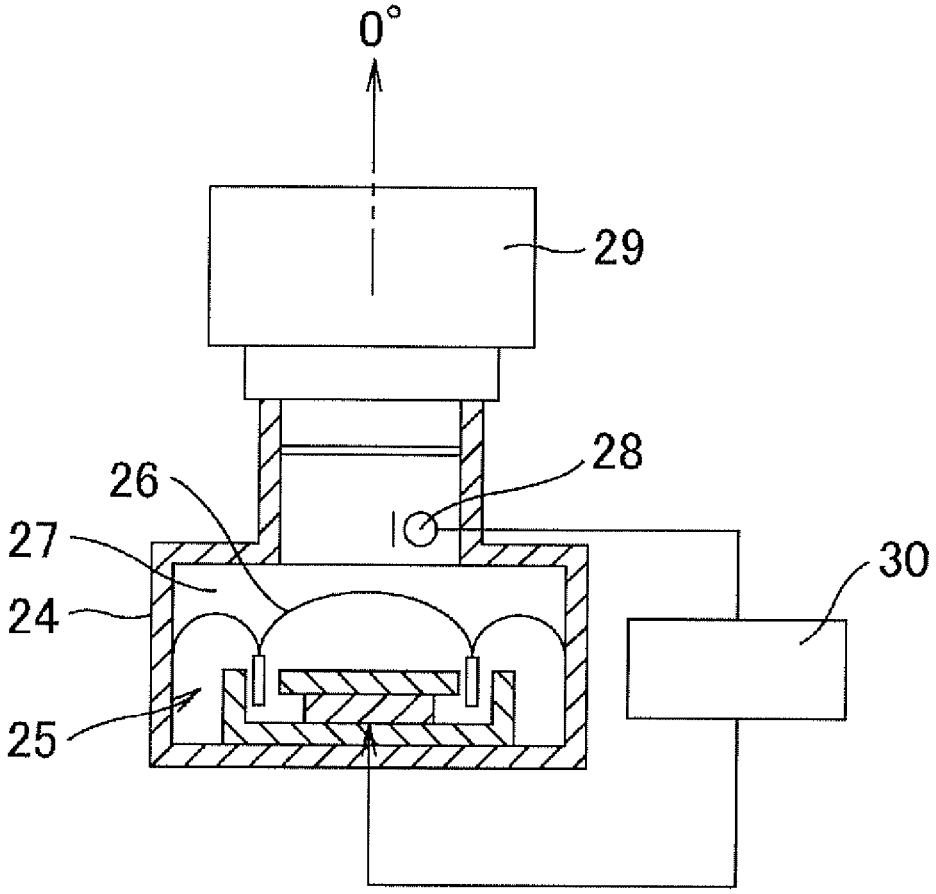
FIG. 3 is a schematic cross-sectional view illustrating an example property tester of an electroacoustic transducer.

In order to demonstrate the advantageous effects of the technological concept of the present invention incorporated into the electroacoustic transducer, frequency property tests were conducted. A tester was compliant with the EIAJ RC-8160 standard. FIG. 3 illustrates a schematic view of the tester. A unidirectional dynamic microphone 29 was used as a device under test. Test sound waves were output to the dynamic microphone 29 from a speaker unit 25 placed 50 cm forward the microphone 29. The sound waves were received and electroacoustically transduced by the microphone 29. The transduced signals were then recorded.

A device to form a space corresponding to the air chamber explained above was provided in back of the microphone 29. The space forming device had a housing 24 and the dynamic speaker unit 25 included in the housing 24. The speaker unit 25 had a diaphragm 26. The housing 24 was partitioned by the diaphragm 26 into a front air chamber 27 and a back air chamber. A microphone unit 28 as a sound pressure detector was disposed in the air chamber 27. Detection signals from the microphone unit 28 were fed back to the speaker unit 25 as a volume adjuster through a circuit block 30, including an amplifier. The detection signals thus drove the speaker unit 25. This feedback control system was turned on or off as desired. The volume of the air chamber 27 in a natural state where the feedback control system was turned off and the speaker unit 25 was not driven was adjusted as desired by moving the mounting position of the dynamic microphone 29, for example.

The tests were performed using the tester under the following three conditions:

(1) Assuming a regular dynamic microphone, the volume of the air chamber 27 was set at 30 cc. The feedback control system was turned off. The acoustic impedance in the air chamber was not controlled.

(2) The volume of the air chamber 27 was set at 2 cc. The feedback control system was turned off. The acoustic impedance in the air chamber was not controlled.

(3) The volume of the air chamber 27 was set at 2 cc. The feedback control system was turned on. The acoustic impedance in the air chamber was controlled. These conditions satisfy the technological concept of the present invention.

Figure 4:
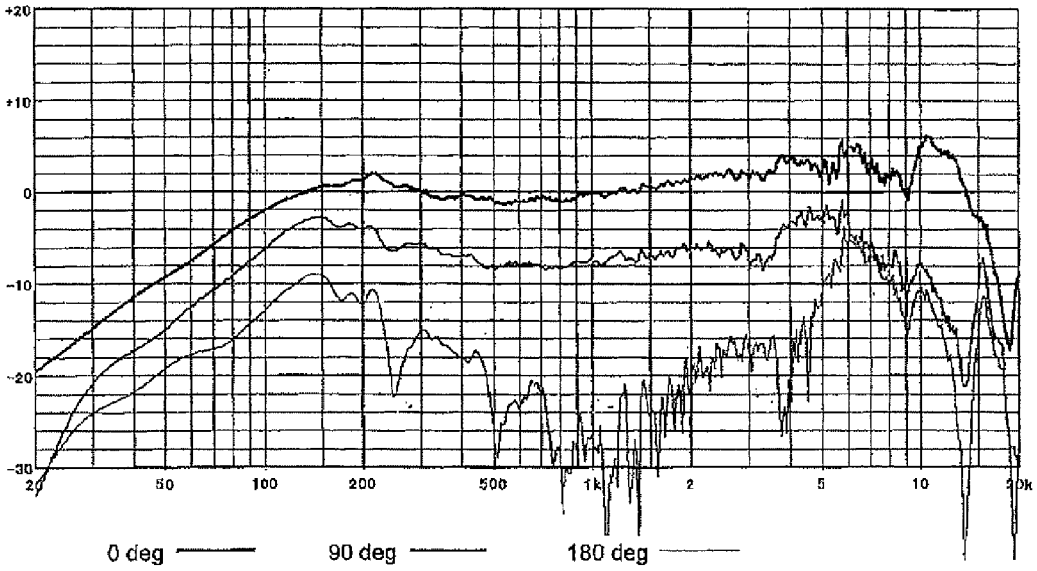
FIG. 4 is a graph illustrating observed results with the tester.
Figure 5:
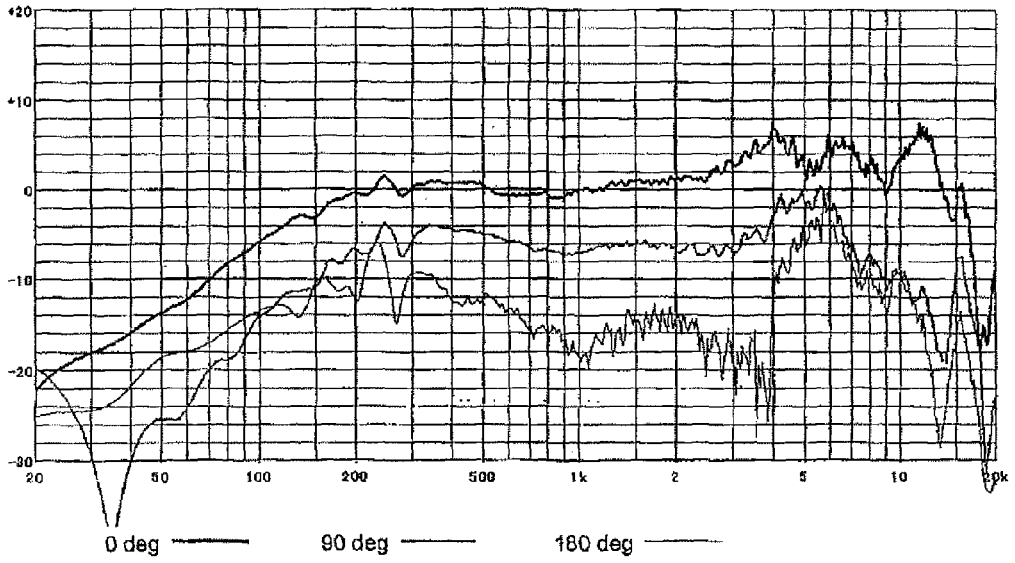
FIG. 5 is a graph illustrating other observed results with the tester.
Figure 6:
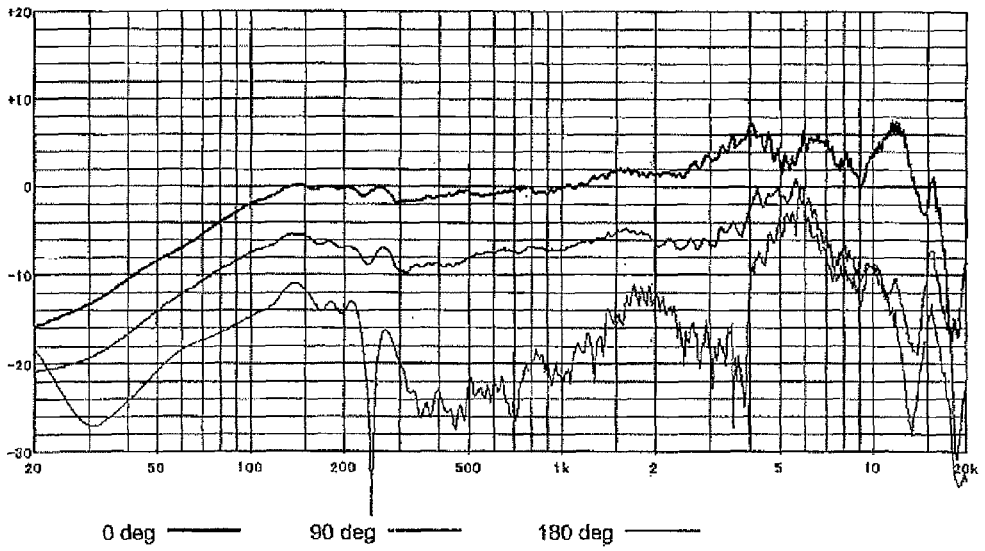
FIG. 6 is a graph illustrating still other results with the tester.

FIG. 4 illustrates the observed results of condition (1); FIG. 5 illustrates the observed results of condition (2); and FIG. 6 illustrates the observed results of condition (3). In the observed results illustrated in each drawing, a thick line represents a case where the speaker outputting test sound waves was placed at an angle of 0 degrees to the center axis, namely in the front; a medium thickness line represents a case where the speaker was placed at an angle of 90 degrees to the center axis; and a thin line represents a case where the speaker was placed at an angle of 180 degrees to the center axis.

As demonstrated in comparison of FIG. 5 and FIG. 6, turning the feedback control system on improves the directional frequency response in bass sound. Thus, the responding frequency level is expanded to a bass range and the bass output level is increased. It is demonstrated in comparison of FIG. 4 and FIG. 6 that turning the feedback control system on improves the frequency response in bass sound more than the case of an increase in the volume of the air chamber 27. These results evidentially show that the electroacoustic transducer satisfying the technological concept of the present invention can exhibit the projected advantageous effects.

Second Embodiment

Figure 7:
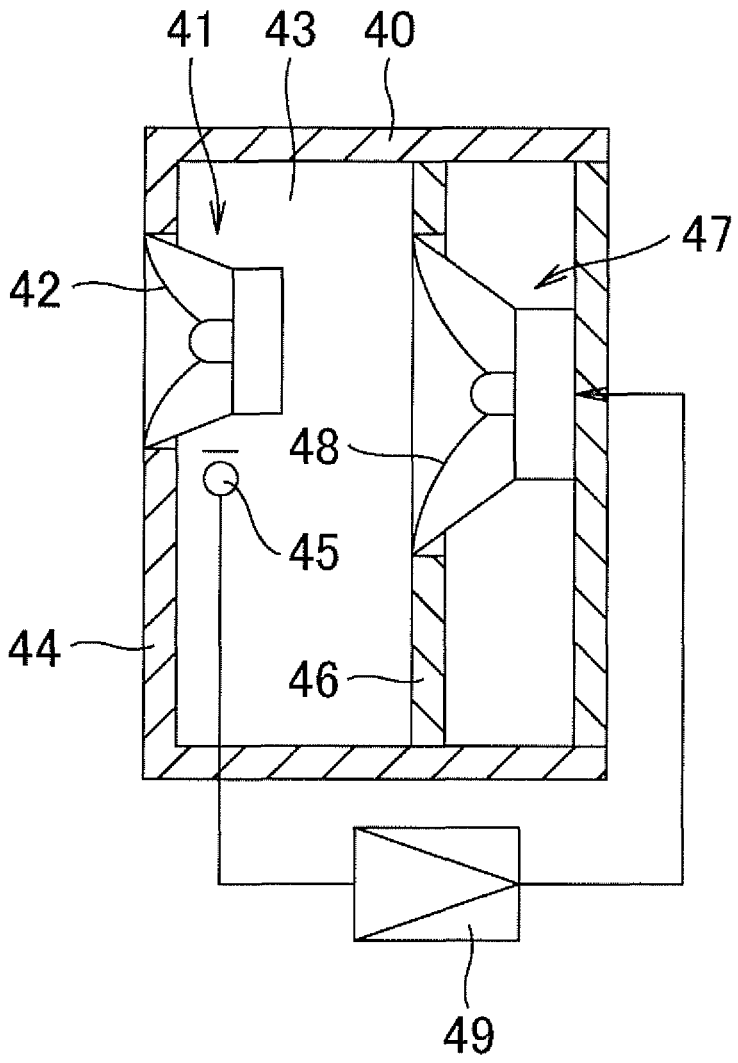
FIG. 7 is a schematic cross-sectional view of an electroacoustic transducer according to another embodiment of the present invention.

An embodiment shown in FIG. 7 is explained, in which the technological concept of the present invention is applied to a speaker system. An electroacoustic transducer in the embodiment shown in FIG. 7 is an example speaker system in which a speaker unit 41 is built into an enclosure 40. The inside of the enclosure 40 is partitioned by a partitioning plate 46. The front plate of the enclosure 40 is a baffle plate 44. An air chamber 43 is defined between the baffle plate 44 and the partitioning plate 46. The speaker unit 41 as an electroacoustic transducer unit is attached to the baffle plate 44 and is located inside the air chamber 43. The air chamber 43 is located in back of a diaphragm 42 of the speaker unit 41. A volume adjuster 47 is attached to the partitioning plate 46. Similar to the speaker unit 41, the volume adjuster 47 has a structure similar to that of a dynamic speaker unit. The volume adjuster 47 has a diaphragm 48, whose front surface faces the air chamber 43. A microphone unit 45 as a sound pressure detector is disposed in the air chamber 43.

Detection signals from the microphone unit 45 are input to the volume adjuster 47 through an amplifier 49. The detection signals are configured to drive the volume adjuster 47. The speaker unit 41 is driven by audio signals from an audio signal source (not shown in the drawing) to vibrate the diaphragm 42 and generate sound. The vibration of the diaphragm 42 changes the volume of the air chamber 43 as well as the sound pressure in the air chamber 43. The microphone unit 45 detects the change in the sound pressure. The sound pressure detection signals output from the microphone unit 45 drive the volume adjuster 47 through the amplifier 49, vibrate the diaphragm 48 of the volume adjuster 47, and change the volume of the air chamber 43.

A feedback control system is thereby formed in which the signals of the sound pressure change in the air chamber 43 detected in the microphone unit 45 as the sound pressure detector are input to the volume adjuster 47 and the sound pressure change in the air chamber 43 is cancelled. Thus, the acoustic impedance in the air chamber 43 can be reduced in an equivalent manner. Even if the air chamber 43 has a small volume, the diaphragm 42 of the speaker unit 41 can be vibrated in response to bass audio signals without resistance, thus improving directional frequency response properties in bass sound. The microphone unit 45 as the sound pressure detector is disposed in the air chamber 43 to directly detect the sound pressure in the air chamber 43 for feedback control with the detection signals, thus allowing acoustic impedance control in the air chamber 43 at high accuracy.

In FIG. 7, the speaker unit 41 for sound playback is smaller than the volume adjuster 47 for acoustic impedance control of the air chamber 43 composed of the speaker unit. The sizes of these components may be determined as desired. These components may have the same size. Alternatively, the volume adjuster 47 may be smaller. To allow easy movement of the diaphragm 48 of the volume adjuster 47, a hole open to the air may be provided to the space in which the volume adjuster 47 is disposed.

Third Embodiment

Figure 8:
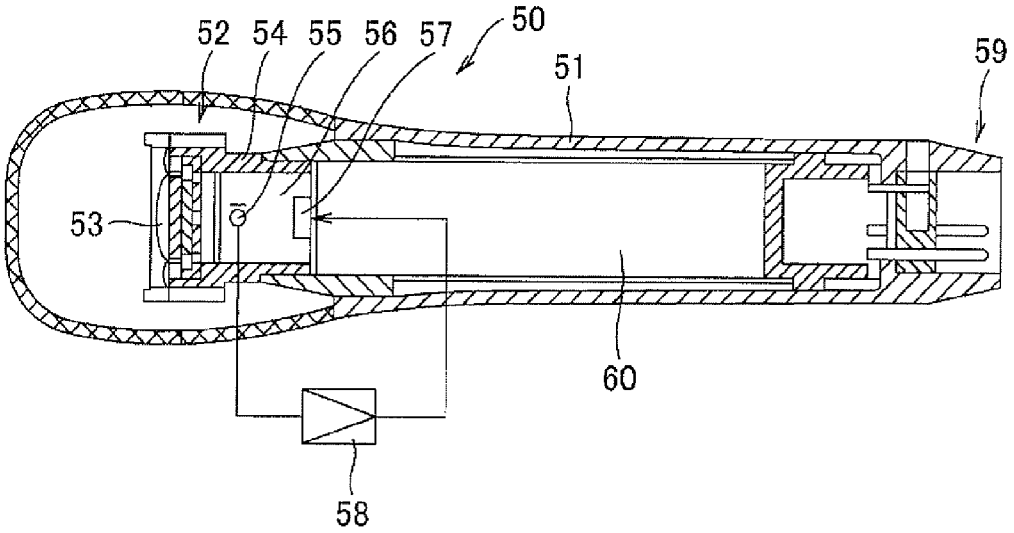
FIG. 8 is a schematic cross-sectional view of an electroacoustic transducer according to another embodiment of the present invention.

FIG. 8 illustrates an embodiment of the technological concept of the present invention that is applied to a dynamic microphone. In FIG. 8, the dynamic microphone 50 has a microphone casing 51 that also serves as a grip. A dynamic microphone unit 52, which is an electroacoustic transducer unit, is appropriately mounted in the front end of the microphone casing 51. The microphone unit 52 has a unit casing 54. A diaphragm 53 that vibrates in response to sound waves is disposed inside the internal periphery in the front end of the unit casing 54. The diaphragm 53 has a voice coil, which is disposed in a magnetic gap formed by magnetic circuit members, such as a permanent magnet and a yoke. The diaphragm 53 vibrates in response to sound waves along with the voice coil, which then outputs audio signals corresponding to the sound waves due to electromagnetic conversion.

The unit casing 54 is provided with an air chamber 56 in back of the diaphragm 53 and the magnetic circuit members. The back surface of the diaphragm 53 is connected to the air chamber 56 through an appropriate hole. A sound pressure detector 55 composed of an omnidirectional microphone unit, for example, is disposed in the air chamber 56. Furthermore, a volume adjuster 57 is disposed in the air chamber 56, the volume adjuster 57 being driven by the output signals from the sound pressure detector 55 and changing the volume of the air chamber 56 in response to the output signals to control the acoustic impedance of the air chamber 56. Similar to the volume adjuster in the previous embodiment, the volume adjuster 57 may employ a structure similar to a dynamic speaker. The output signals from the sound pressure detector 55 are amplified in an amplifier 58 and the amplified signals drive the volume adjuster 57.

A connector 59 is provided in the rear end of the microphone casing 51 to connect a cable connector. In the microphone casing 51, a power battery compartment 60 is provided between the microphone unit 52 and the connector 59. The dynamic microphone 50, which is provided with the power battery compartment 60, is a microphone that requires a power source, similar to a wireless microphone. The volume of the air chamber 56 is thus limited by the power battery compartment 60. Accordingly, the stiffness of the air chamber 56 is high and the diaphragm 53 of the microphone unit 52 moves barely in bass sound, thus leading to poor directional frequency response in bass sound. In the case of a pin-type wireless microphone in particular, the entire size is small, in which a power battery should to be installed, thus further reducing the volume of the air chamber and further lowering the directional frequency response in bass sound. In the embodiment shown in FIG. 8, the volume adjuster 57 is provided in the air chamber 56 and is driven by the output signals from the sound pressure detector 55 through the amplifier 58. A control system from the sound pressure detector 55 to the volume adjuster 57 through the amplifier 58 configures a feedback control system in which the volume adjuster 57 increases the volume of the air chamber 56 as the sound pressure in the air chamber 56 increases so as to reduce the acoustic impedance of the air chamber 56 in an equivalent manner.

According to the embodiment of the microphone shown in FIG. 8, the diaphragm 53 of the dynamic microphone unit 52 vibrates in response to received sound waves, and then the volume of the air chamber 56 fluctuates and the sound pressure of the air chamber 56 fluctuates. The fluctuation in the sound pressure is fed back to the volume adjuster 57, which is then driven to control the sound pressure in the air chamber 56 at a constant level. Accordingly, even if the air chamber 56 has a small volume, the acoustic impedance of the air chamber 56 is reduced in an equivalent manner. Thus, the diaphragm 53 can vibrate properly according to the sound pressure and provide a microphone excellent in directional frequency response.

It is mainly bass sound in which the directional frequency response is lowered due to the small volume of the air chamber. It is thus preferred in each embodiment explained above that the detection signals from the sound pressure detector be input to the volume adjuster through a low-pass filter so as to reduce the acoustic impedance in bass sound in the air chamber in an equivalent manner.

Applying the technological concept of the present invention to a speaker sufficiently increases the volume or pressure of bass sound, even if an enclosure attached to the speaker has a small volume, thus providing a compact and high-performance speaker system.

Furthermore, applying the technological concept of the present invention to a microphone provides a high-performance microphone capable of electroacoustically transducing sound at a high level even in bass sound, even if an air chamber is extremely small in back of a diaphragm of a microphone unit, such as in a pin-type wireless microphone, as an electroacoustic transducer unit.

The volume adjuster of the present invention is not limited by a drive type. In addition to the configuration similar to the dynamic speaker employed in each of the embodiments, a member similar to an electromagnetic actuator may be used to drive a diaphragm facing an air chamber in order to control the volume of the air chamber. Alternatively, a piezoelectric element, such as a piezoelectric bimorph, may be used to control the volume of the air chamber.

What is claimed is:

1. A microphone comprising:

a microphone unit comprising a first diaphragm vibrating in response to sound waves from a sound source;

an air chamber having a variable volume in response to vibration of the first diaphragm;

a sound pressure detector detecting a sound pressure in the air chamber; and a volume adjuster, having a second diaphragm forming one side of the air chamber, driven by output signals from the sound pressure detector, changing the volume of the air chamber in response to the output signals from the sound pressure detector, and controlling an acoustic impedance of the air chamber according the change of the volume of the air chamber, wherein the second diaphragm is vibrated in response to the output signals from the sound pressure detector and changes the volume of the air chamber, and wherein the sound pressure detector and the volume adjuster configure a feedback control system increasing the volume of the air chamber with an increase in the sound pressure in the air chamber.

2. The microphone according to claim 1, wherein the microphone unit is incorporated into a unit casing, and wherein the unit casing includes the air chamber having the variable volume in response to vibration of the first diaphragm.

3. The microphone according to claim 2, wherein the unit casing is incorporated into a microphone casing and the microphone casing includes a power battery compartment.

4. The microphone according to claim 1, wherein detection signals from the sound pressure detector are input to the volume adjuster through a low-pass filter.

* * * * *